US005207751A

United States Patent [19]

Suzuki et al.

[11] Patent Number: 5,207,751

[45] Date of Patent: May 4, 1993

[54] SWASH PLATE TYPE PUMP WITH SWASH PLATE TILT ANGLE CONTROLLER

[75] Inventors: Shigeru Suzuki; Hisashi Kuriya; Kunifumi Goto, all of Kariya, Japan

[73] Assignee: Kabushiki Kaisha Toyoda Jidoshokki Seisakusho, Kariya, Japan

[21] Appl. No.: 848,017

[22] Filed: Mar. 9, 1992

[30] Foreign Application Priority Data

Mar. 11, 1991 [JP] Japan ..... 3-045148

[51] Int. Cl.[5] ..... F04B 1/28

[52] U.S. Cl. ..... 417/222.1; 60/452; 60/443

[58] Field of Search ..... 92/12.2; 417/222 R; 91/506; 60/443, 452

[56] References Cited

U.S. PATENT DOCUMENTS 3,054,263 9/1962 Buozich et al. ..... 60/452 X
3,523,419 8/1970 Hindle ..... 60/452 X
3,942,486 3/1976 Kirchner ..... 417/222 R
4,600,364 7/1986 Nakatani et al. ..... 417/222 R
5,066,201 11/1991 Nagai et al. ..... 60/443 X

FOREIGN PATENT DOCUMENTS 60-19776 2/1985 Japan .

*Primary Examiner*—Leonard E. Smith
*Attorney, Agent, or Firm*—Brooks Haidt Haffner & Delahunty

[57] ABSTRACT

Disclosed is a swash plate type variable displacement pump. The pump comprises a spring which biases a swash plate in a direction of decreasing the tilting angle thereof, a hydraulic cylinder which controls the swash plate at the tilt angle according to a load on the pump by the resisting force against the biasing force of the spring, a valve allows a pressurized fluid to flow into the hydraulic cylinder when opened, and prevents the pressurized fluid from coming out of the hydraulic cylinder when closed, and a fluid discharge passage which gradually releases the resisting force of the hydraulic cylinder against the spring to slowly shift the tilt angle of the swash plate to 0°.

14 Claims, 3 Drawing Sheets

SWASH PLATE TYPE PUMP WITH SWASH PLATE TILT ANGLE CONTROLLER

BACKGROUND OF THE INVENTION

1. Field of the Invention

The present invention relates to a swash plate type variable displacement pump which drives hydraulic devices and a special-purpose vehicle which has this pump installed therein.

2. Description of the Related Art

Swash plate type variable displacement pumps are widely employed in various industrial machines and industrial vehicles. Japanese Unexamined Utility Model Publication No. 60-19776, for example, discloses one such swash plate type variable pumps. This pump will now be explained referring to FIG. 1.

In the described pump, the opening end of a cup-shaped casing 101 is covered by an end plate 102, thereby forming a crank case 103. A drive shaft 104 that extends into the crank case 103 is supported by the casing 101 and the end plate 102 via bearings 105. A plurality of cylinder blocks 106 are carried by the drive shaft 104 such that they extend in parallel to the drive shaft 104. Thus, the cylinder blocks 106 rotate integrally with the drive shaft 104 inside the crank case 103. Each cylinder block 106 has a bore 107 formed therein. A reciprocable piston 110 is provided in each bore 107. These pistons 110 are coupled to a swash plate 109 through shoes 108.

A valve plate 111 is attached to the end plate 102 adjacent the open end of the bores 107. The valve plate 111 includes an inlet port **112*a* and a discharge port 112*b* positioned along the rotational locus of openings 107*a* of bores 107. The ports 112*a* and 112*b* communicate with external hydraulic circuits through an inlet port 113*a* and a discharge port 113*b* formed in the end plate 102. The pistons 110 are reciprocated in accordance with the rotation of the cylinder blocks 106, therefore. When a pistons 110 moves away from the end plate (to the left in FIG. 1), it enlarges the volume of the sealed spaces of the bores 107. Thus, a working fluid is sucked in the bores 107 through the inlet port 112*a*. On the other hand when the pistons 110 move towards the end plate, they reduce the volume of the sealed spaces of the respective bores 107, thereby discharging working fluid from the bores 107 through the discharge port 112*b***.

The swash plate 109 is supported by a support shaft (not shown), and is urged by a bias spring 114 in a direction to increase the tilting angle. During use, the actions of the pistons 110 themselves tend to urge the swash plate 109 in a direction that decreases the tilting angle. Additionally, a hydraulic cylinder 115 positioned 180° from the swash plate 109 applies a hydraulic positioning force against the swash plate. Accordingly, the actual tilt angle of the swash plate 109, is determined by several combined forces.

In the above-described pump, the spring 114 urges the swash plate 109 in a direction to increase the tilting angle. When the operation of the pump is stopped, pressurized fluid leaks from the cylinder blocks 106 through clearances which are provided to allow the pistons 110 to slide in the cylinder blocks 106 and/or pressurized fluid flows out from a fluid circulation orifice which is provided in the cylinder 115 or its control circuit, dropping the fluid-discharge pressure. As a result, the cylinder 115 loses resisting force, and the swash plate 109 is held still at the maximum angle by the urging force of the spring 114. When the pump is activated again, it will begin operation at its maximum capacity which means that its starting torque will be very large. Thus the initial power consumption will be relatively high and the pump has poor response to large load changes.

The amount of fluid discharged from the pump has to be kept at "0" or close to "0" when the pressurized fluid does not need to be supplied to hydraulic devices. The above-described pump, however, has a limited pressure range of the working fluid that is applied to the cylinder 115, and cannot acquire fluid pressure corresponding to the angle of the swash plate 109 being in the vicinity of 0°. For this reason, with the swash plate 109 held at around 0° C. and the discharge amount set almost to "0, " the operation of the pump cannot continue. It is therefore necessary to provide a clutch between the pump and its input side so as to separate the pump from the input side when the pump is free of a load.

FIG. 2 exemplifies the transmission system of a pump mounted on a special-purpose vehicle, such as a dump truck. As is apparent from FIG. 2, power is transmitted from an engine 120 to a power take-off (PTO) device 122 via a transmission 121, and then sent through a transmission shaft 123 and an electric clutch 124 to drive a pump 125. The structure including the transmission shaft 123 and the clutch 124 complicates the unit and increases the manufacturing cost.

FIG. 3 illustrates another transmission system in which the electric clutch 124 is eliminated, where the pump 125 is driven by turning the power take-off device 122 on and off. This system inevitably requires a complicated operation for turning the PTO device 122 on or off. Specifically, it requires the following steps in order:

(a) switching the drive range of a shift lever by operating a foot brake,
(b) turning the power take-off device 122 on (activating the pump 125),
(c) switching the parking range of the shift lever,
(d) operating a dump truck (during a work period from the beginning of the work to the end of the work),
(e) switching the drive range of the shift lever by operating the foot brake, and
(f) turning off the power take-off device 122 (deactivating the pump 125).

SUMMARY OF THE INVENTION

It is therefore an object of the present invention to provide a swash plate type variable displacement pump which reduces the starting torque to save power.

It is another object of the present invention to provide a swash plate type variable displacement pump which shortens the time for transition from the minimum to the maximum capacity to thereby have an excellent response to a load.

It is a further object of the present invention to provide a swash plate type variable displacement pump which can reduce the number of required components to provide a simplified structure and lower manufacturing cost.

It is a still further object of the present invention to provide a special-purpose vehicle which has the aforementioned swash plate type variable displacement pump installed therein with a view to simplifying a pump driving unit and improving operating characteristics.

To achieve these objects, according to the present invention, there is provided a variable displacement pump which has a swash plate supported rotatable in a housing, and in which the swash plate is displaced from a position almost perpendicular to a drive axis of the pump to a drive axis side to increase a tilting angle of the swash plate from almost 0° to a maximum tilting angle, and the capacity of the pump rises based on the increase of the tilting angle, the pump comprising a member for always urging the swash plate in a direction to reduce the tilting angle, and an adjusting member for displacing the swash plate at the tilting angle according to a load applied on the pump by resisting force against urging force of the urging member, and gradually removing the resisting force against the force of the urging member to slowly change the tilting angle to 0°.

According to another aspect of the present invention, there is provided a special-purpose vehicle, such as the aforementioned dump truck or a mobile mixer, which employs the above-described swash plate type variable displacement pump as a hydraulic pump where power of an engine is transmitted via a power take-off device, thus eliminating the need for employing a clutch.

DETAILED DESCRIPTION OF THE PREFERRED EMBODIMENT

Figure 1:
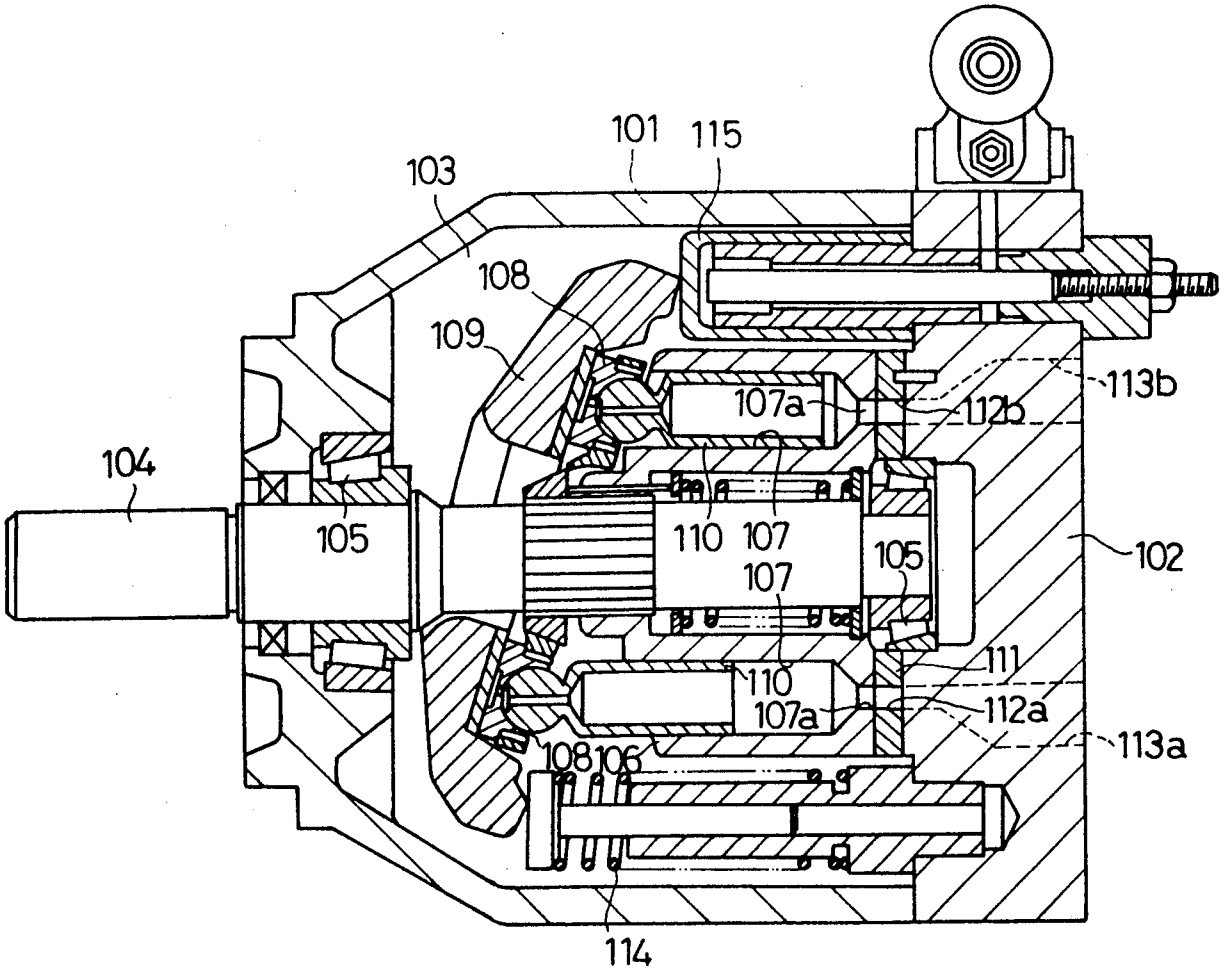
Fig. 1 (PRIOR ART)
FIG. 1 is a cross sectional view of a conventional variable displacement piston pump.
Figure 2:
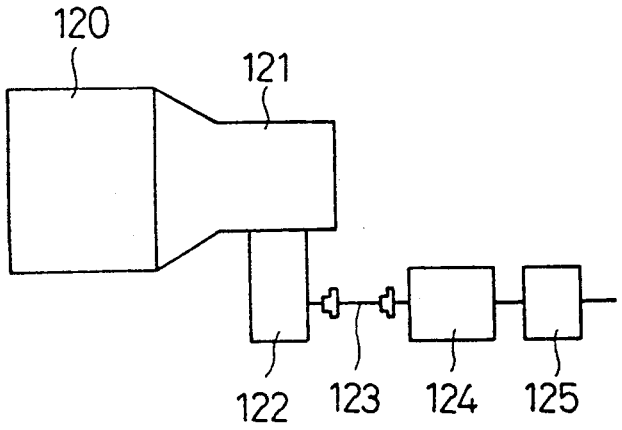
Fig. 2 (PRIOR ART)
FIG. 2 is a schematic diagram illustrating the transmission system of the conventional pump mounted on a special-purpose vehicle.
Figure 3:
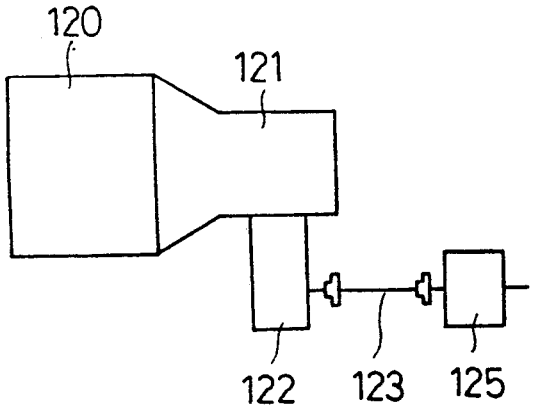
Fig. 3 (PRIOR ART)
FIG. 3 is a schematic diagram illustrating another conventional transmission system.
Figure 4:
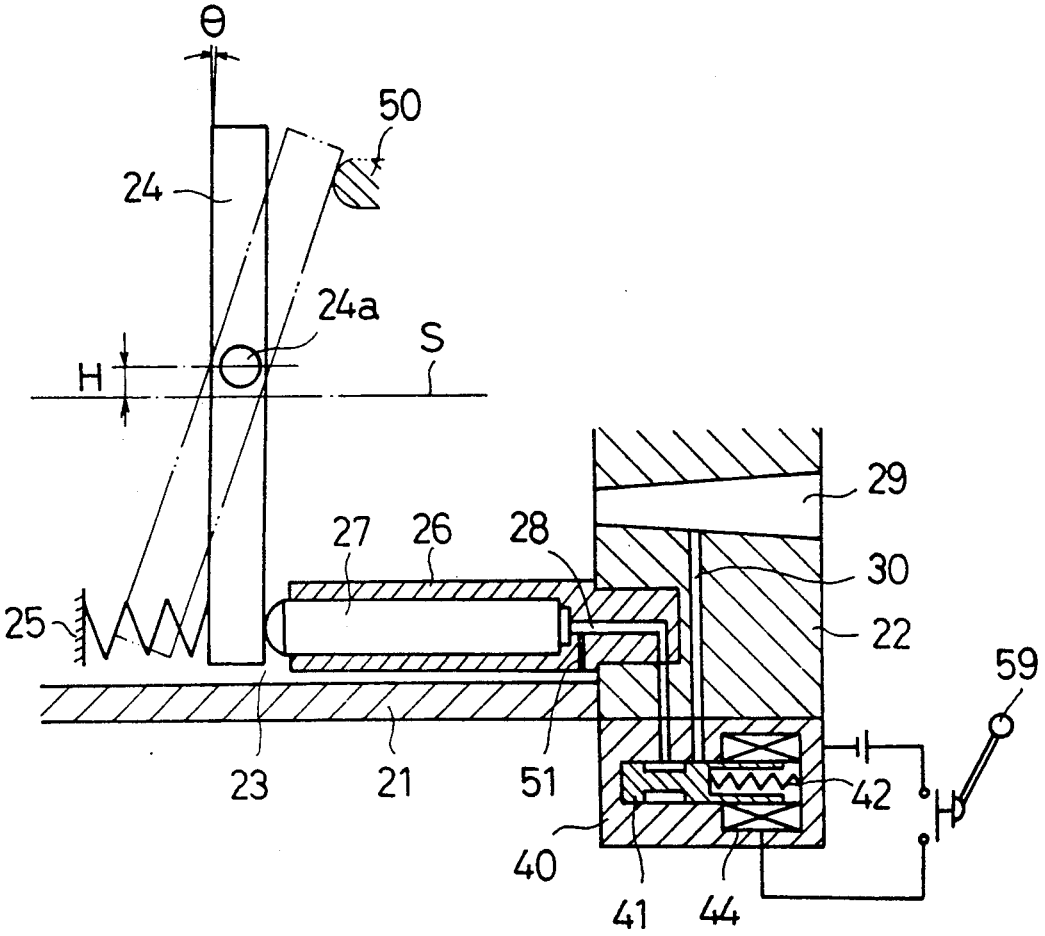
FIG. 4 is diagrammatic cross section view showing only the variable displacement mechanism of a variable displacement pump according to the present invention.

A preferred embodiment of the present invention will now be described in detail referring to FIGS. 4 and 5. FIG. 4 is a diagrammatic partial cross section view showing a mechanism for displacing the tilting angle of a swash plate in a variable displacement piston pump.

The pump has a cup shaped casing 21 having end plate 22 covering its open end. This forms an airtight crank case 23 in the casing 21. A swash plate 24 for controlling the discharge amount of the pump in the crank case 23 is supported by the casing 21 in such a way that a trunnion pivot point 24A is eccentric toward a top dead point (upward in the diagram) by a predetermined value H with respect to a drive axis S. A bias spring 25 urges the swash plate 24 in the direction of a decreasing tilt angle. A hydraulic cylinder 26 extends from the end plate 22 in parallel to the drive axis S. The hydraulic cylinder includes a hydraulically controlled piston rod 27 that urges the swash plate 24 in a direction that increases its tilt angle against the force of the spring 25.

In the position shown in FIG. 4 the piston rod 27 is withdrawn all of the way into the cylinder 26 and is stopped at the end of its stroke. This fully withdrawn position holds the swash plate 24 at the minimum tilting angle $\theta$ (about 1°). The maximum tilting angle of the swash plate 24 is decided by a stopper 50.

A pressurized fluid passage 28 is connected to a bore 26A of the cylinder 26. A discharge port 29 is formed in the end plate 22 for discharging pressurized fluid from the compressor. The discharge port 29 communicates with a small pressurized-fluid passage 30. The passages 28 and 30 can communicate with each other through an electric valve 40. This valve 40 will be explained below.

The valve 40 has a spool 41 which selectively permits communication between the passages 28 and 30. The spool 41 is normally forcibly held at the closed (disconnection) position by a spring 42. When an electric switch 43 is turned on, a solenoid 44 is driven to displace the spool 41 to the open (communication) position against the force of the spring 42. A bleed passage 51 permits the passage 28 to communicate with the crank case 23.

Figure 5:
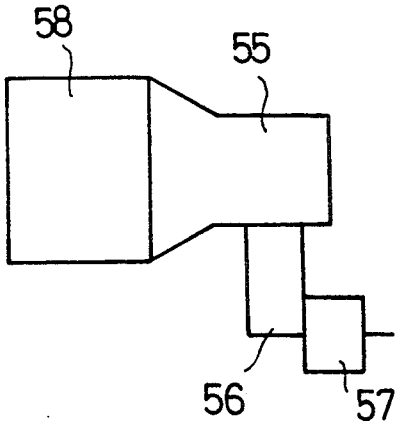
FIG. 5 is a schematic diagram illustrating the transmission system of the variable displacement pump according to the present invention mounted on a special-purpose vehicle.

FIG. 5 illustrates a variable displacement pump 57 of this type mounted on a special-purpose vehicle, such as a dump truck. In this case, the pump 57 is directly connected to a power take-off device 56 attached to a transmission 55. The power take-off device 56 is set normally in an ON state, and the switch 43 is rendered on and off, interlocking with the operation of a load lever like a dump lever 59 provided in a driver's cab.

When an actuator is not operated (i.e. there is no load), the valve 40 is closed as shown in FIG. 4. Even if the pump 57 is driven by the power take-off device 56 in the normally ON state, the swash plate 24 keeps the minimum tilting angle $\theta$ (about 1°) equivalent to zero capacity, and thus serves as a clutch (in the OFF state). When the switch 43 is turned "on" to open the valve 40, the discharge fluid is gradually supplied from the passage 29 through the valve 40 and the passage 28 to the cylinder 26. Consequently, the piston rod 27 is pushed out of the cylinder 26 to increase the tilt angle of the swash plate 24. The pump 57 therefore starts operating with the minimum capacity equal to "0". Thus, the pump's power consumption is reduced in this manner.

When the tilt angle of the swash plate 24 reaches the maximum level after the pump 57 gradually starts working with the minimum capacity, the operation of the pump 57 is shifted to a steady operation with the maximum capacity. It is therefore possible to prevent drastic change in the load, ensuring a steady operation.

In this embodiment, the pump is designed so that the pivot point 24*a* of the swash plate 24 is eccentric toward the top dead point by the predetermined value H with respect to the drive axis S. Compared with the structure where the pivot point of the swash plate is set on the drive axis of the swash plate, as pressure in the bore of the cylinder 26 rises, the compression repulsive force more rapidly increases the tilting angle of the swash plate 24. The variable displacement pump of this embodiment can therefore start without delay and ensure excellent response characteristics. Further, since the tilt angle of the swash plate 24 can be quickly changed, the minimum tilt angle can be set to a smaller value than that of the prior art.

When the loading by operation of a dump truck, for example, is complete and the switch 43 is turned "off", the valve 40 is closed. The pressurized fluid then leaks through the bleed 51 thereby reducing the pressure which has urged the swash plate 24 in a direction to increase its tilting angle. Accordingly, the biasing spring 25 gradually urges the swash plate 24 towards decreasing tilt angles. This in turn reduces the pumps capacity to the minimum, (in this case about "0"). Thus, the pump continues to rotate, but it stops discharging the pressurized fluid. The power which has been transmitted from the engine 58 via the transmission 55 to the power take-off device 56 is therefore cut off by the pump 57, thereby stopping the operations of various hydraulic devices. It is therefore possible to eliminate a component such as a clutch, thereby lowering manufacturing costs and simplifying the structure.

What is claimed is:

1. A variable displacement pump having a swash plate rotatably supported in a housing, the swash plate being displaceable from a minimum tilt angle position that is substantially perpendicular to a drive axis of the pump to a maximum tilt angle position, the capacity of the pump being varied in accordance with the tilt angle, the pump comprising:

a bias means for biasing the swash plate in a direction to reduce the tilt angle;

a positioning means for controlling the position of the swash plate, the positioning means including a hydraulic cylinder and being arranged to apply a positioning force to the swash plate in the opposite direction to the force of the bias means; and an adjusting means for adjusting the magnitude of the positioning force, the adjusting means including a valve that permits a pressurized fluid to flow into the hydraulic cylinder in an open state and cuts off the pressurized fluid in a closed state, the adjusting means being arranged to gradually reduce the positioning force when the pump is inactivated, and further has a bleed passage that leaks a fluid from the hydraulic cylinder when the valve is in the closed state.

2. A special-purpose vehicle provided with an axial type variable displacement pump to which engine rotation is transmitted via a transmission and a power take-off device, said pump including a swash plate displaceable from a minimum tilt angle position that is substantially perpendicular to a drive axis of the pump to a maximum tilt angle position, the capacity of the pump being varied in accordance with the tilt angle, the pump further comprising:

a bias means for biasing the swash plate in a direction to reduce the tilt angle;

a positioning means for controlling the position of the swash plate, the positioning means including a hydraulic cylinder and being arranged to apply a positioning force to the swash plate in the opposite direction to the force of the bias means;

an adjusting means for adjusting the magnitude of the positioning force, the adjusting means having a valve that permits a pressurized fluid to flow into the hydraulic cylinder in an open state and cuts off the pressurized fluid in a closed state and further having a bleed passage that permits the pressurized fluid to leak from the hydraulic cylinder when the valve is closed, the adjusting means being arranged to gradually reduce the positioning force when the pump is inactivated; and an electric switch for giving an instruction to enable and disable fluid discharge of the pump.

3. A variable displacement pump having a swash plate rotatably supported in a housing, the swash plate being displaceable from a minimum tilt angle position that is substantially perpendicular to a drive axis of the pump to a maximum tilt angle position, the capacity of the pump being varied in accordance with the tilt angle, the pump comprising:

a spring for biasing the swash plate in a direction to reduce the tilting angle;

a hydraulic cylinder for applying resisting force against biasing force of the spring to the swash plate;

an electric switch for giving an instruction to enable and disable fluid discharge of the pump;

an electric valve which closes and opens a fluid passage to the hydraulic cylinder based on the instruction from the electric switch; and a fluid leakage passage that permits the fluid in the hydraulic cylinder to leak when the valve is closed.

4. A variable pump according to claim 3, wherein a rotational center of the swash plate is set eccentric to the drive axis of the pump in a direction away from action points of the spring and the hydraulic cylinder to the swash plate.

5. A variable displacement pump having a swash plate rotatably supported in a housing, the swash plate being displaceable from a minimum tilt angle position that is substantially perpendicular to a drive axis of the pump to a maximum tilt angle position, the capacity of the pump being varied in accordance with the tilt angle, the pump comprising:

a bias means for biasing the swash plate in a direction to reduce the tilt angle;

a positioning means for controlling the position of the swash plate, the positioning means being arranged to apply a positioning force to the swash plate in the opposite direction to the force of the bias means; and an adjusting means for adjusting the magnitude of the positioning force, the adjusting means being arranged to gradually reduce the positioning force when the pump is inactivated, the swash plate of the pump having a pivot center set eccentric to the drive axis of the pump in a direction away from action points of the bias means and the positioning means on the swash plate.

6. A variable pump according to claim 5, wherein the bias means is a spring that urges the swash plate towards its minimum tilt angle, the spring being sized sufficiently to draw the swash plate to its minimum position when the pump is inactivated.

7. A variable pump according to claim 5, wherein the positioning means includes a hydraulic cylinder.

8. A variable pump according to claim 7, wherein the adjusting means includes a valve that permits a pressurized fluid to flow into the hydraulic cylinder in an open state, and cuts off the pressurized fluid in a closed state.

9. A special-purpose vehicle provided with an axial type variable displacement pump to which engine rotation is transmitted via a transmission and a power take-off device, said pump including a swash plate displaceable from a minimum tilt angle position that is substantially perpendicular to a drive axis of the pump to a maximum tilt angle position, the capacity of the pump being varied in accordance with the tilt angle, the pump further comprising:

a bias means for biasing the swash plate in a direction to reduce the tilt angle;

a positioning means for controlling the position of the swash plate, the positioning means being arranged to apply a positioning force to the swash plate in the opposite direction to the force of the bias means; and an adjusting means for adjusting the magnitude of the positioning force, the adjusting means being arranged to gradually reduce the positioning force when the pump is inactivated, the swash plate of the pump having a rotational center set eccentric to the drive axis of the pump in a direction away from action points of the bias means and the positioning means on the swash plate.

10. A special-purpose vehicle according to claim 9, wherein the biasing means of the pump is a spring that urges the swash plate towards its minimum tilt angle, the spring being sized sufficiently to draw the swash plate to its minimum position when the pump is inactivated.

11. A special-purpose vehicle according to claim 9, wherein the pump further includes an electric switch for giving an instruction to enable and disable fluid discharge of the pump.

12. A special-purpose vehicle according to claim 11, wherein the electric switch interlocks with a loading operation member in the special-purpose vehicle.

13. A special-purpose vehicle according to claim 11, wherein the control means of the pump includes a hydraulic cylinder.

14. A special-purpose vehicle according to claim 13, wherein the adjusting means of the pump has a valve that permits a pressurized fluid to flow into the hydraulic cylinder in an open state, and cuts off the pressurized fluid in a closed state.

* * * * *